US005090217A

United States Patent [19]

Beber et al.

[11] Patent Number: 5,090,217

[45] Date of Patent: Feb. 25, 1992

[54] GEM MOUNTING

[76] Inventors: Jacque S. Beber; Richard A. Beber, both of 2061 Mesa Dr., Santa Ana Heights, Calif. 92707

[21] Appl. No.: 693,604

[22] Filed: Apr. 30, 1991

[51] Int. Cl.[5] ..... A44C 17/02

[52] U.S. Cl. ..... 63/27; 269/156

[58] Field of Search ..... 63/26, 27, 29.1, 30, 63/13, 32; 269/156; 81/4, 7; 261/DIG. 14; 248/346; D11/91, 92; 206/566; 40/639; 125/35

[56] References Cited

U.S. PATENT DOCUMENTS

| | | | |
|---|---|---|---|
| D. 116,337 | 8/1939 | Gaertner | D11/92 |
| D. 239,651 | 4/1976 | Hess | D11/92 |
| 649,785 | 5/1900 | Weinert | 269/156 X |
| 1,567,516 | 12/1925 | Kirchner | D11/91 X |
| 2,265,956 | 12/1941 | Schenck | 63/27 |
| 2,377,222 | 5/1945 | Fruth | 63/26 X |
| 2,774,231 | 12/1956 | Peterson | D11/92 X |
| 2,775,878 | 1/1957 | Eichhorn | 63/15 |
| 2,811,024 | 10/1957 | Thompson | 63/26 |
| 4,697,437 | 10/1987 | D'Annunzio | 63/15.5 |

FOREIGN PATENT DOCUMENTS

| | | | |
|---|---|---|---|
| 433067 | 3/1935 | United Kingdom | 63/26 |

*Primary Examiner*—Renee S. Luebke
*Assistant Examiner*—Michael J. Milano
*Attorney, Agent, or Firm*—Schwartz & Weinrieb

[57] ABSTRACT

A mounting for a gem that tapers to a bottom tip has a base with an opening for receiving a tiny bit of the end of the tip and arms for engaging and holding the gem below its uppermost surface. The peripheral shape of the mounting may correspond generally to the largest peripheral shape of the gem. The mounting displays the gem in a manner that makes essentially the entire surface of the gem visible for viewing.

18 Claims, 2 Drawing Sheets

GEM MOUNTING

BACKGROUND OF THE INVENTION

This invention relates to devices that hold gems, and more particularly to mountings for displaying gems.

Settings and mountings for gems have been constructed for the purpose of increasing the amount of light reflected on the gems in order to make small or inferior gems appear larger or to increase their brilliancy. Often, the structure of a setting will detract from or obscure a well sculptured quality gem. In particular, when a gem has a precision multi-faceted or brilliant cut, prior mountings do not display the gem in the most advantageous manner.

OBJECTIVES OF THE INVENTION

Accordingly, it is an object of the invention to provide an improved mounting for gems.

Another object is to provide a mounting that does not obscure or detract from the appearance of a well cut quality gem.

A further object is to provide a mounting that emphasizes the exposure of the attractive lower portion of a precision shaped gem.

Still another object is to provide a mounting that displays a triangularly shaped multi-faceted or brilliant cut gem in an elegant manner.

A still further object is to provide a simple, attractive, easily produced precious metal mounting that displays essentially an entire gem in an artistic manner, and that does not possess defects found in similar prior art gem mountings.

Other objects and advantages of the invention will be found in the specification and claims, and the scope of the invention will be set forth in the claims.

DESCRIPTION OF THE INVENTION

Figure 4:
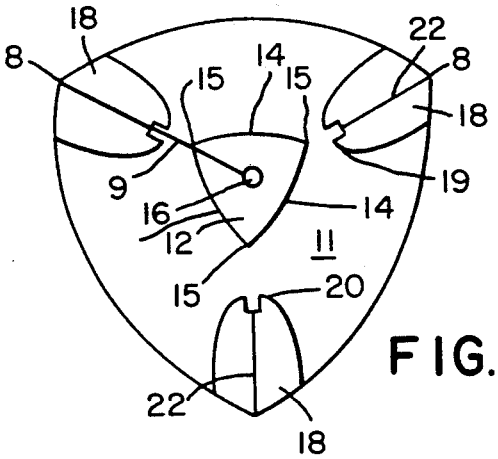
FIG. 4 is a top view of the gem mounting from FIGS. 1–3.
Figure 6:
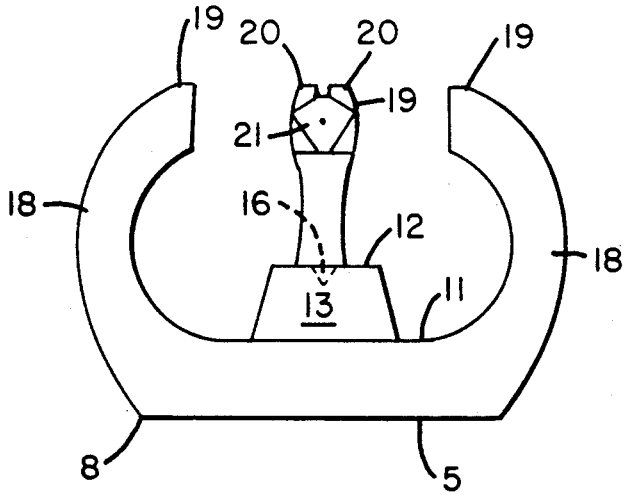
FIG. 6 is an end view of the mounting in FIG. 4.

The drawing shows a mounting 1 in accord with this invention for holding and displaying a gem such as multifaceted diamond 2. Mounting 1 is an integral body that may be cast from a precious metal such as gold and has a base 3 with substantially flat horizontal bottom surface 5 that supports the mounting. The peripheral edge 6 of base 3 is curved and generally triangular in shape. Edge 6 is defined by three essentially identical arcs 7 that intersect at the vertices 8 of edge 6. A raised platform 10 that is centered on base 3 and extends vertically above the upper surface 11 of base 3 has a substantially flat horizontal upper surface 12. The peripheral edge 13 of platform 10 is curved and generally triangular in shape. Edge 13 is defined by three essentially identical arcs 14 that intersect at the vertices 15 of edge 13. A small hole 16 is centered in the upper surface 12 of platform 10, and hole 16 is dimensioned to receive the small portion of the end of pointed tip 17 of gem 2. As shown in FIG. 4, each vertex 15 of the peripheral edge 13 of platform 10 lies substantially on an imaginary straight line 9 that extends from the center of hole 16 to one of the vertices 8 of the peripheral edge 5 of base 3. Mounting 1 has three symmetrically spaced curved arms 18 that project upwardly from the vertices 8 of the base. Arms 18 have ends 19 that are located vertically above the upper surface 12 of platform 10, and each end 19 is bifurcated to define a pair of spaced prongs 20 for engaging and holding gem 2 above platform 10. Each end 19 is also indented at 21 adjacent prongs 20 to aid in holding gem 2. Each arm 18 has a central spine 22 that extends up its center directly from one of the vertices 8 of base 3.

Figure 7:
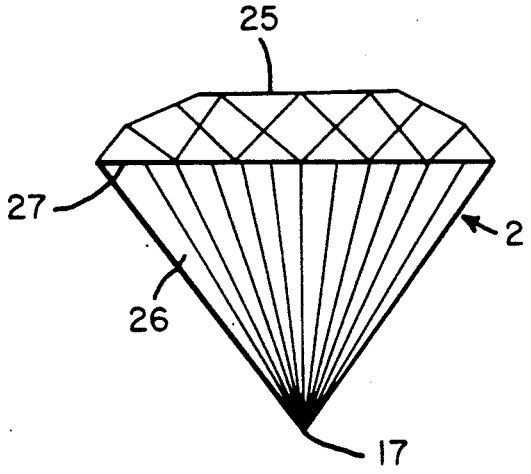
FIG. 7 is a side view of the gem from FIGS. 1–3.
Figure 8:
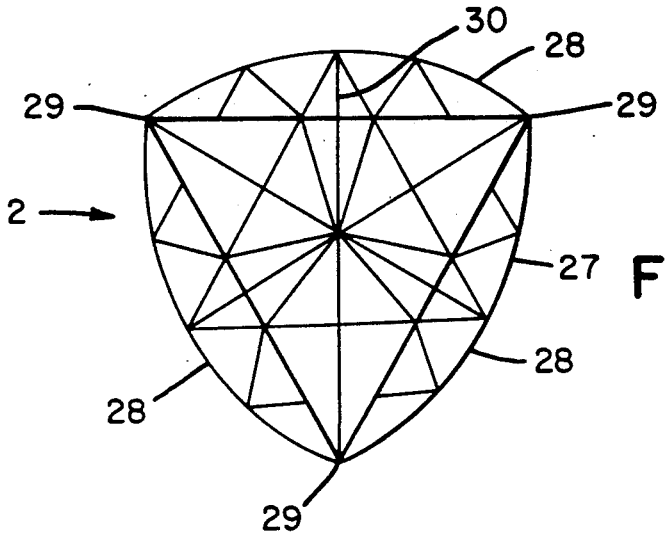
FIG. 8 is a top view of the gem in FIG. 7.

Mounting 1 can be used to display in an elegant manner a diamond or other gem 2 having a multi-faceted cut as shown in FIGS. 7 and 8. Gem 2 has a flat horizontal upper surface 25, and its facets 26 meet at bottom terminal pointed tip 17. Facets 26 may be oriented and arranged in a predetermined manner to define a curved generally triangular ridge or girdle 27 on gem 2 between its upper surface 25 and pointed tip 17. Ridge 27 is defined by three essentially identical arcs 28 that intersect at the vertices 29 of the ridge, and flat surface 25 has the shape of an equilateral triangle having its corners at vertices 29. Ends 19 of arms 18 engage and hold ridge 27 at vertices 29 between the bottom tip 17 and flat upper surface 25 of gem 2. The length of gem 2 (i.e. the distance between point 17 and upper surface 25) is less than its width (i.e. the length of line 30) according to this embodiment of this invention.

Figure 1:
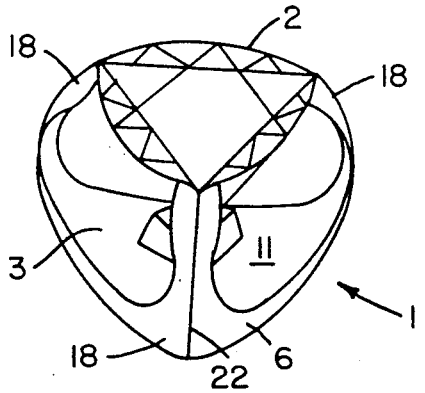
FIG. 1 is a perspective view of a gem and mounting in accord with this invention.
Figure 2:
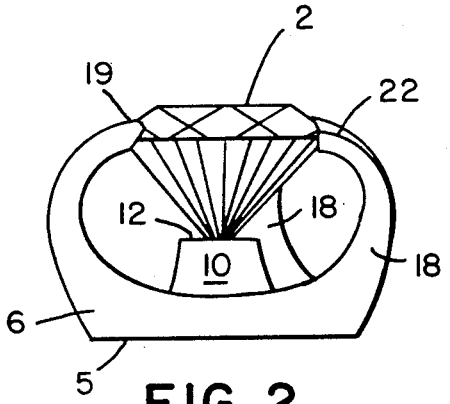
FIG. 2 is a side view of the invention shown in FIG. 1.
Figure 3:
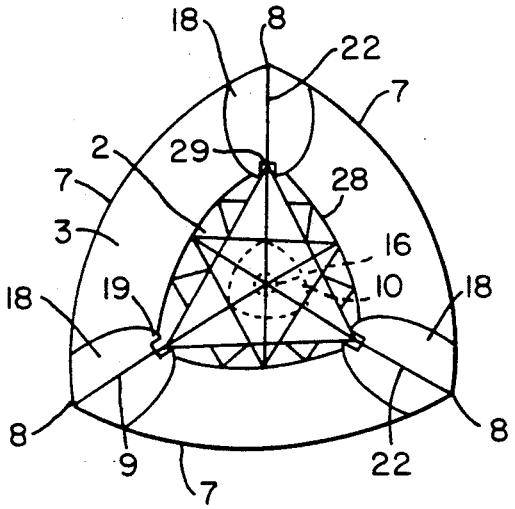
FIG. 3 is a top view of the invention shown in FIG. 1.
Figure 5:
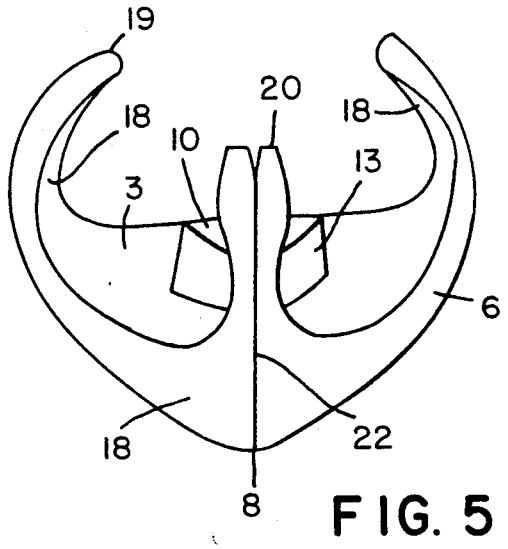
FIG. 5 is a perspective view of the gem mounting in FIG. 4.

As shown in FIG. 3, gem 2 is displayed in mounting 1 with the vertices of ridge 27 aligned with the corresponding vertices 8 and 15 of base 3 and platform 10. Also, the corresponding arcs 7, 14 and 28 curve or bow in the same direction, so that the general peripheral outline of mounting 1 corresponds to the largest peripheral shape of gem 2 such that the general peripheral outline of said mounting 1 is at least equal in size to the peripheral shape of gem 2. Thus, each of the vertices 29 of ridge 27 lies on an imaginary line 9 that extends between small hole 16 and one of the vertices 8 of base 3, with each vertex 29 being located between one of the vertices 15 of raised platform 10 and one of the vertices 8 of the base. This enables mounting 1 to display gem 2 in its most elegant manner with substantially all of the gem being visible to the eye. In particular, mounting 1 emphasizes the exposure for viewing of the attractive precision cut facets at the lower portion of the gem below ridge 27 without detracting from the view of the triangular flat upper surface 25.

While the invention has been described with reference to a particular embodiment, it is not intended to illustrate or describe herein all of the equivalent forms or ramifications thereof. Also, the words used are words of description rather tham limitation, and various changes may be made without departing from the spirit or scope of the invention disclosed herein. It is intended that the appended claims cover all such changes as fall within the true spirit and scope of the invention.

What is claimed is:

1. A mounting for a gem that has a pointed tip, comprising:

a base;

a raised platform extending upardly from said base, there being a small hole in said platform for receiving said pointed tip of said gem; and a plurality of arms projecting upwardly and directly from said base and disposed radially outwardly of said platform such that distal ends of said arms engage and hold portions of said gem above said pointed tip.

2. The invention defined in claim 1, wherein said mounting comprises three symetrically spaced curved arms for holding said gem.

3. The invention defined in claim 2, wherein each of said curved arms terminates in a pair of spaced prongs for engaging said gem.

4. The invention defined in claim 1, wherein said raised platform has a substantially flat upper surface and said small hole is centered in said upper surface.

5. The invention defined in claim 4, wherein said upper surface is substantially horizontal.

6. The invention defined in claim 1, wherein said base has a substantially flat, horizontal bottom surface.

7. The invention defined in claim 1, wherein said base has a curved generally triangular peripheral edge defined by three essentially identical arcs that intersect at the vertices of its triangular edge.

8. The invention defined in claim 7, wherein said raised platform has a curved generally triangular peripheral edge defined by three essentially identical arcs that intersect at the vertices of said triangular edge.

9. The invention defined in claim 8, wherein each of said vertices of said triangular peripheral edge of said raised platform lies substantially on a straight line extending between said small hole and one of said vertices of said triangular edge of said base.

10. An integral mounting for a gem that has a pointed tip, comprising:

a base having a substantially flat horizontal bottom surface and a curved generally triangular peripheral edge defined by three essentially identical arcs that intersect at the vertices of its triangular edge;

a raised platform extending upwardly from said base having a substantially flat horizontal upper surface and a curved generally triangular peripheral edge defined by three essentially identical arcs that intersect at the vertices of its triangular edge, there being a small hole centered in said upper surface for receiving said pointed tip; and three symetrically spaced curved arms projecting upwardly and directly from said vertices of said base and disposed radially outwardly of said platform, each of said arms terminating in a pair of spaced prongs for engaging and holding said gem in a substantially horizontal plane above its pointed tip.

11. The invention defined in claim 10, wherein each of said vertices of said triangular peripheral edge of said raised platform lies substantially on a straight line extending between said small hole and one of said vertices of said triangular edge of said base.

12. The invention defined in claim 10, wherein each of said arms has a spine that extends up its center directly from one of the vertices of said edge of said base.

13. The combination comprising a gem having a plurality of facets that intersect at a bottom terminal pointed tip, a flat horizontal upper surface, and said facets being oriented so as to define a curved generally triangular ridge on said gem between said upper surface and said tip; and an integral mounting for displaying said gem comprising a base, a raised platform extending upwardly from said base and having its upper surface above said base, there being a small hole in said upper surface of said platform and said pointed tip extending into said hole, and three symetrically spaced curved arms projecting upwardly and directly from said base and disposed radially outwardly of said platform such that distal ends of said arms engage and hold portions of said triangular ridge of said gem between its pointed tip and its flat upper surface.

14. The invention defined in claim 13, wherein said upper surface of said raised platform is substantially flat and horizontal.

15. The invention defined in claim 13, wherein said triangular ridge of said gem is defined by three essentially identical curved arcs that intersect at the verticies of said triangular ridge and said curved arms of said mounting engage said gem at said vertices.

16. The invention defined in claim 15, wherein said base has a curved generally triangular peripheral edge defined by three essentially identical arcs that intersect at the vertices of said triangular edge of said base and each of said vertices of said ridge lies substantially on a line extending between said small hole and one of said vertices of said base.

17. The invention defined in claim 16, wherein said raised platform has a curved generally triangular peripheral edge defined by three essentially identical arcs that intersect at the vertices of said triangular edge, and each of said vertices of said raised platform lies substantially on one of the lines extending between said small hole and one of said vertices of said base, and each of said vertices of said ridge being located between one of said vertices of said raised platform and one of said vertices of said base.

18. The invention defined in claim 17, wherein the corresponding arcs of said gem, said base, and said raised platform curve in the same direction.

* * * * *